United States Patent [19]

Trubiano

[11] Patent Number: 4,597,616

[45] Date of Patent: Jul. 1, 1986

[54] DRAWER-LIKE CONTAINER ASSEMBLY

[75] Inventor: Antoine Trubiano, Pointe aux Trembles, Canada

[73] Assignee: Cari-All Inc., Quebec, Canada

[21] Appl. No.: 666,439

[22] Filed: Oct. 30, 1984

[51] Int. Cl.[4] ..... A47F 5/08

[52] U.S. Cl. ..... 312/246; 312/345; 312/348; 211/113; 211/181

[58] Field of Search ..... 312/348, 246, 247, 342, 312/345; 211/181, 113, 118, 119; 248/318

[56] References Cited

U.S. PATENT DOCUMENTS

| | | | |
|---|---|---|---|
| 1,684,563 | 9/1928 | Swedman | 312/345 |
| 1,774,312 | 8/1930 | Braeutigam | 312/345 |
| 1,774,313 | 8/1930 | Braeutigam | 312/345 |
| 2,018,002 | 10/1935 | Avery | 312/113 |
| 2,089,359 | 8/1937 | Goulooze | 312/246 |
| 2,188,044 | 1/1940 | Hickman | 312/246 |
| 3,220,625 | 11/1965 | Protheroe | 312/246 |
| 3,259,447 | 7/1966 | Deutsch | 312/348 |

*Primary Examiner*—William E. Lyddane
*Assistant Examiner*—Geald A. Anderson
*Attorney, Agent, or Firm*—Oblon, Fisher, Spivak, McClelland & Maier

[57] ABSTRACT

A drawer-like container assembly comprising a support frame for slidingly supporting a rectangular container having at least opposed engageable side support members. The frame has a pair of spaced elongated container engaging channels for slidingly engaging the side supports on a respective side of the container. A retention gate is pivotally connected to the frame and positionable internally of the container for abutment with a rear portion of the container for retaining the container in the frame and limiting outward sliding displacement of the container when slidingly engaged by the frame. The retention gate is also positionable outwardly of the container to permit removal of the container from the frame.

5 Claims, 5 Drawing Figures

DRAWER-LIKE CONTAINER ASSEMBLY

BACKGROUND OF INVENTION

The present invention relates to a drawer-like container assembly which comprises a wire support frame which is engageable under a shelf and which is provided with a retention gate which is pivotally connected thereto whereby to limit outward sliding displacement of the container but permitting the container to be removed from the frame by displacing the gate outwardly of the top end of the container.

(b) Description of Prior Art

Various types of drawer-like container assemblies whereby to support a container under a shelf are known. However, these known types of assemblies have various drawbacks. For example, some of these do not have any means to prevent the drawer-like container from being pulled entirely out of its support frame. Accordingly, if the user pulls out the drawer excessively, the drawer falls out of its support frame with its contents being damaged. A common application of such drawer-like containers is its use in hospitals wherein a plurality of these containers are secured on a mobile frame. These containers or baskets are usually filled with all types of medical supplies, most of which are carried in glass bottles and it can be appreciated that if one of these containers becomes dislodged from its support frame, the contents thereof will often be destroyed and cause injury to bystanders.

There is also the need to provide a container assembly whereby the assembly is light-weight and can easily be attached or detached from under a wire-like shelf and wherein the container cannot slide off its support frame unless a stop mechanism is released, but wherein the drawer can easily be positioned within the support frame.

SUMMARY OF INVENTION

It is a feature of the present invention to provide a drawer-like container assembly which substantially overcomes all of the above-mentioned disadvantages of the prior art.

It is a further feature of the present invention to provide a light-weight drawer-like container assembly comprising a support frame and an open-ended container and wherein the assembly can be quickly and securely attached to wire-like members and suspended therefrom.

Another feature of the present invention is to provide a drawer-like container assembly incorporating therein a retention gate which is automatically engaged with the container when the container is slid within its frame and which limits the outward sliding displacement of the container in the frame.

It is a further feature of the present invention to provide a drawer-like container assembly wherein the support is constructed of wire meshing and the container is an open-ended plastics container of light-weight construction.

According to the above features, from a broad aspect, the present invention provides a drawer-like container assembly comprising a support frame for slidingly supporting a rectangular container having at least opposed engageable side support members. The frame has a pair of spaced elongated container engaging means for slidingly engaging the side supports on a respective side of the container. Retention means is pivotally connected to the frame and positionable internally of the container to abut with a rear portion of the container for retaining the container and the frame and limiting outward sliding displacement of the container when slidingly engaged by the frame. The retention means is also positionable outwardly of the container to permit removal of the container from the frame.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
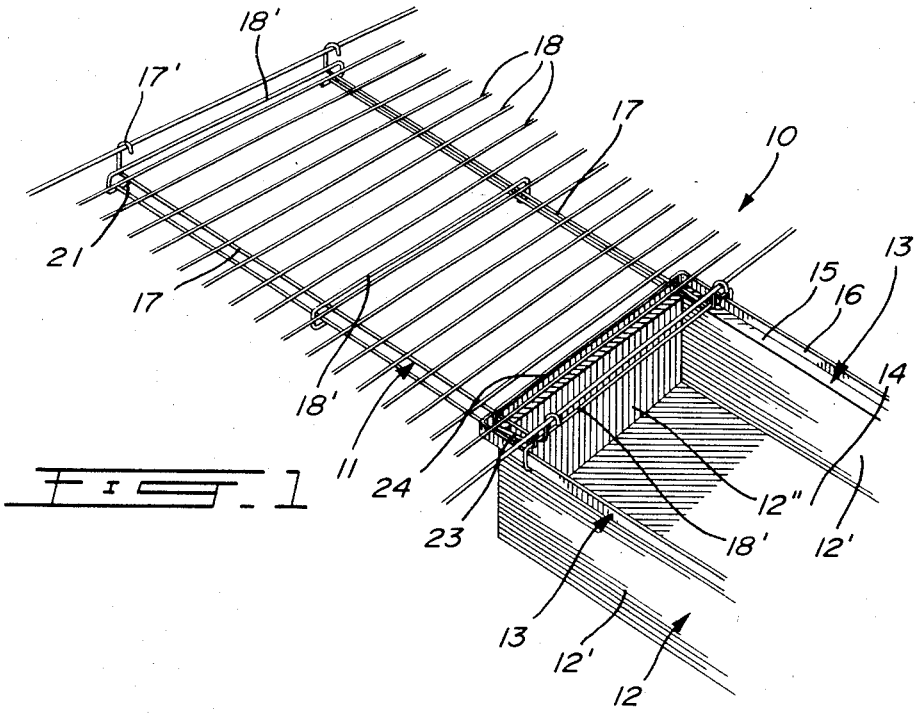
FIG. 1 is a perspective fragmented view of the drawer-like container assembly of the present invention.

Referring now to the drawings, and more particularly to FIG. 1, there is shown generally at 10 the drawer-like container assembly which comprises essentially a support frame 11 and a rectangular open-ended container 12. The container as herein shown is a plastic container having an outwardly extending peripheral flange 13 about its top open end 14. The flange has a flat bottom wall 15 and an upwardly extending end wall 16. This flange constitutes engageable side support members above the side walls 12' of the container.

The support frame, as herein shown, is constituted by a top wall formed of at least two spaced apart longitudinal wire members 17 and a plurality of transverse wire members 18 connected to the longitudinal wire members 17 by means such as spot welds. At least two, herein three, of the transverse wire members and namely, members 18', are provided with opposed U-shaped ends with their free ends facing inwardly under the top wall formed by the wire members 17 and 18 to define a pair of spaced apart elongated container engaging means in the form of channels for slidingly receiving the flanges 13 at the top end of the side walls 12' of the container 12. A straight wire 19 is connected near the free end 20 of the U-shaped ends of the transverse wire members to constitute a support surface on which the bottom wall 15 of the side wall flanges 13 are supported.

Figure 5:
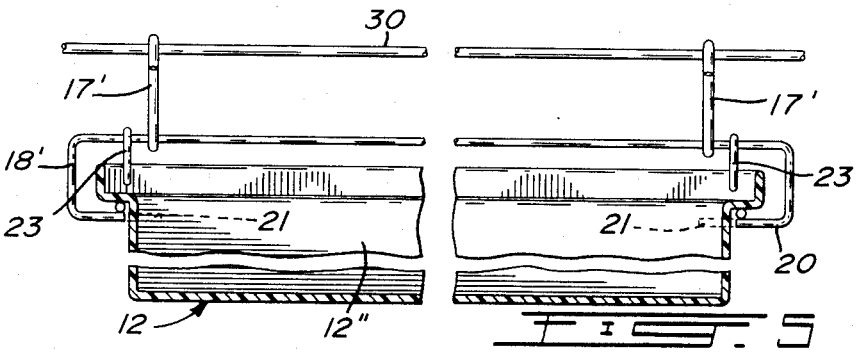
FIG. 5 is a front section view across the drawer showing the position of the retention gate and the rear stop member.

The rear one of the transverse wire members 18' has its U-shaped end having a longer free end portion 21 to define a stop means whereby to abut against the rear wall 12'' of the container when the container is pushed fully within the support frame 11 to prevent the container from sliding out the other end. The position of this stop means is illustrated in FIG. 5.

Referring now additionally to the other drawings, in order to prevent the drawer 12 from being slid accidentally out of its support frame 11 when slidingly engaged thereby, there is provided a retention means in the form of a retention gate 22. This gate 22 is formed as an elongated U-shaped wire member having short side arms 23 and a long interconnecting arm 24. The short side arms 23 have a loop-shaped free end portion 25 which is secured about the forward one of the transverse wire members 18' for pivotal displacement of the gate about the wire member 18'. The other end of the short side arms 23 has a bent shoulder portion 26 to define an abutting end with the long interconnecting arm extending from an upper end of the shoulder portions 26.

Figure 2:
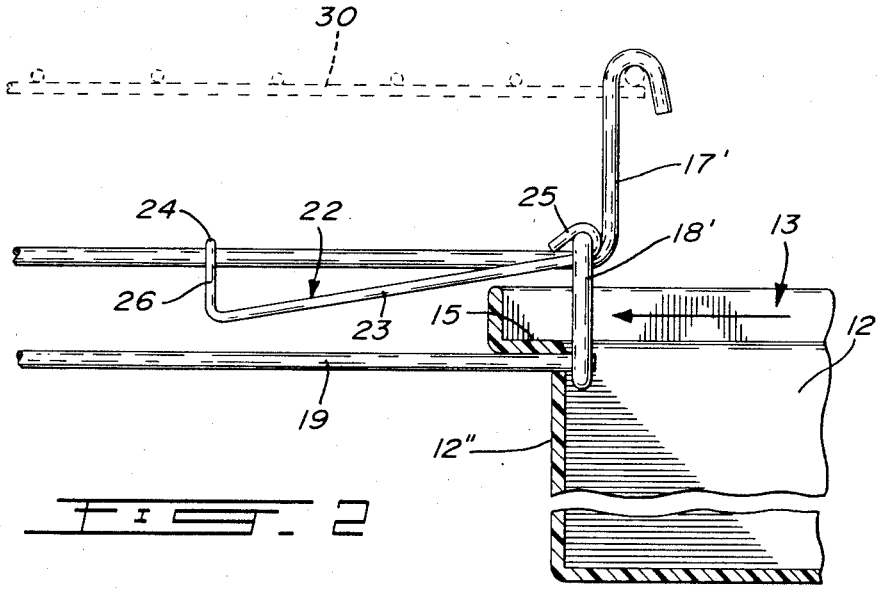
FIG. 2 is a fragmented side section view illustrating the positioning of a drawer within the support frame adjacent the retention gate.
Figure 3:
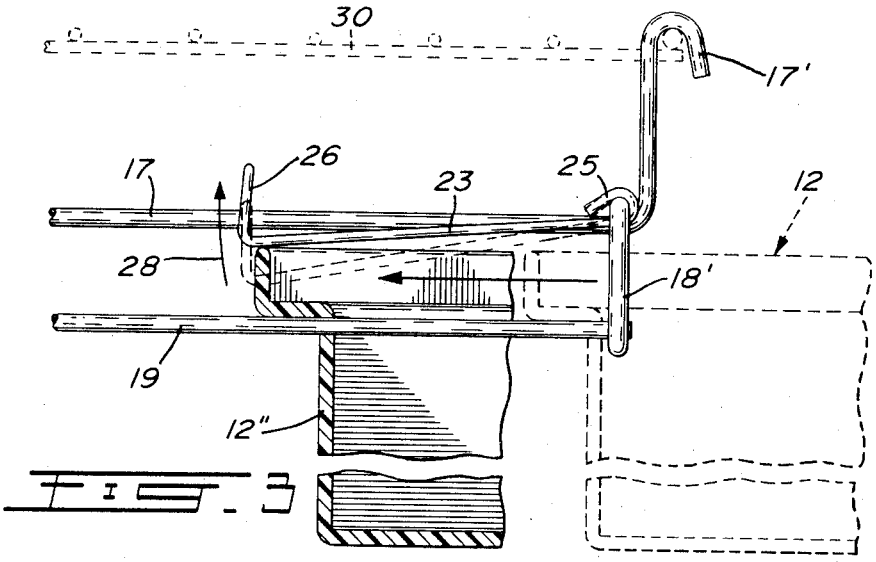
FIGS. 3 and 4 are respective section views, similar to FIG. 2, showing the operation of the retention gate.
Figure 4:
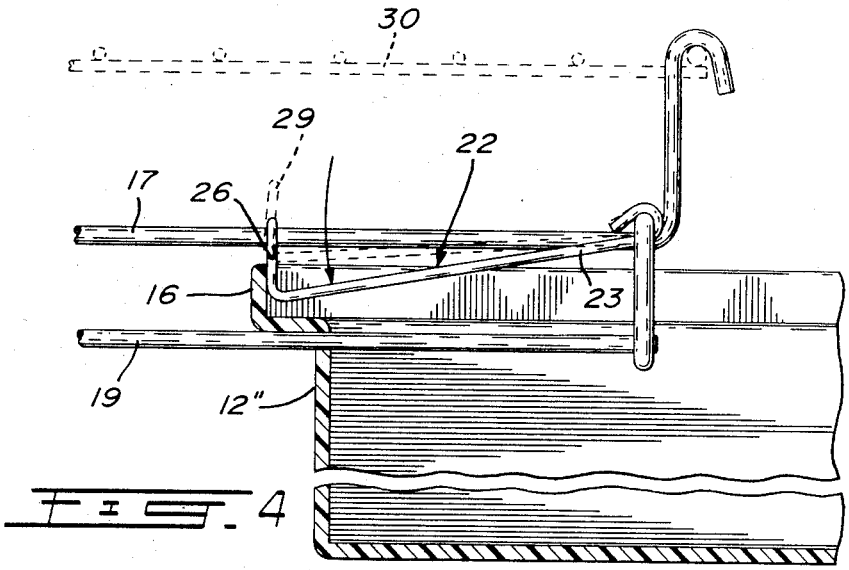

The operation of the gate member is illustrated in FIGS. 2 to 4. As therein shown, the long interconnecting arm 24 of the gate member is disposed above the longitudinal wire members 17 and rests thereon to support the shoulder portions 26 slightly elevated from the flange bottom wall 15 but extending sufficiently within the channels whereby to locate itself closely spaced above the bottom wall 15 of the flange internally of the drawer when the drawer is engaged between the channels. As shown in FIG. 2, the retention gate 22 is in its position of rest or engagement. As the drawer 12 is pushed within the frame with its flange 13 engaged in respective channels, the flange on top of the foremost end wall of the container will push against the short arms 23 of the gate thereby lifting the gate upwardly in the direction of arrow 28 to permit entry of the container within the support member 11. As soon as the flange passes the shoulder portion 26 of the gate, the gate will then assume its position of rest, as shown in FIG. 4, and locate itself internally of the container above the flange. Accordingly, the drawer can no longer be pulled out of the frame as the shoulder portion 26 will abut against the upwardly extending side wall portion 16 of the flange disposed above the rear wall 12" of the container. In order to disengage the gate member 22 from the container, it is only necessary to grasp with the fingers and move it upwardly to the position as shown in phantom lines 29 in FIG. 4, and pull the drawer out.

In order to attach or suspend the support frame 11 from a wire shelf, such as shown in phantom lines 30 in FIG. 2 or other attachment-like structure, there is provided support means in the form of an upward vertical end extension at opposed ends of the longitudinal wire members 17, which extension terminates in a hook end 17' with the opening of all four hooks facing in a common direction. Thus, the support frame 11 is quickly and securely attached to cross-wires of a support shelf and depends thereunder in parallel relationship with the shelf.

It is within the ambit of the present invention to cover any obvious modifications of the example of the preferred embodiment described herein. For example, the container may have support flanges at the top end of its side walls only, or else may have two or more short support flanges spaced apart on the top of each side wall. The shoulder portion 26 of the gate member could then be shaped differently whereby to protrude lower than the channel members and inwardly of the container and abut against the rear wall 12' of the container. Also, the gate may be formed as a shorter U-shaped wire member and located centrally of the container but being supported by some of the wires in the top wall of the support frame not to fall freely within the container and obstruct material contained therein. However, the preferred gate construction is that shown in the drawings wherein the gate cannot obstruct any products contained within the container as it is disposed outwardly of the container side walls.

A specific application of the drawer-like container assembly as disclosed herein is for use in hospital dollies where a mobile frame is provided with a plurality of spaced apart vertical shelves and one of these assemblies is suspended from each of the shelves. This container assembly also has a multitude of other applications such as in the food industry, needle trade, etc.

I claim:

1. A drawer-like container assembly comprising a wire support frame for slidingly supporting a rectangular open-ended container having opposed near and front walls and two side walls, said side walls each having a flange connected to and protruding outwardly of said container in a peripheral region of said open end, said frame having a pair of spaced elongated container engaging channels for slidingly receiving said flange on each respective side of said container, a gate member hinged to a front end of said frame above said elongated channels, said gate member being positionable internally of said container and having a free abutting end to abut a rear portion of said end wall for retaining said container in said frame and limiting outward sliding displacement of said container when slidingly engaged by said frame, said retention means being also positionable outwardly of said container to permit removal of said container from said frame, and stop means to abut said container to limit inward sliding displacement thereof in said support frame, said support frame having a wire frame comprising at least two spaced apart longitudinal wire members and a plurality of transverse wire members connected to said longitudinal wire members to define a wire wall; at least two of said transverse wire members near the ends of said frame having downwardly extending U-shaped ends facing inwardly under said top wall to define said elongated channel, a straight wire connected near the free end of said U-shaped ends to constitute a support surface of said channels, a rear one of said U-shaped ends having a longer free end portion than said other U-shaped ends to define an extension portion to constitute said stop means.

2. A container assembly as claimed in claim 1 wherein there is further provided an upward vertical end extension of opposed ends of said longitudinal wire members and terminating in a hook end all facing a common direction to support said frame member under a wire shelf.

3. A container assembly as claimed in claim 1 wherein said gate member is an elongated U-shaped wire member having short side arms and a long interconnecting arm, said side arms having a loop-shaped free end secured about a forward one of said transverse wire members for pivotal displacement of said gate and a bent shoulder portion at its other end, said long interconnecting arm extending from an upper end of said should portions.

4. A container assembly as claimed in claim 3 wherein said container is an open-ended plastics container having an outwardly extending peripheral flange about its open end, said flange having a bottom wall and an upwardly extending end wall, said side arms of said gate member lying above a respective one of said bottom walls of said peripheral flange on opposed sides of said basket.

5. A container assembly as claimed in claim 4 wherein said long interconnecting arm is disposed above said longitudinal wire members and rests thereon to support said shoulder portions slightly elevated from said flange bottom wall but to abut against said upwardly extending end wall of said flange disposed above a rear wall of said container when said container is pulled in the outward direction of said frame.

* * * * *